United States Patent [19]

Strigl

[11] Patent Number: 4,685,965

[45] Date of Patent: Aug. 11, 1987

[54] PROCEDURE FOR DEOXIDIZING METAL MELTS

[75] Inventor: Reinhard Strigl, Munich, Fed. Rep. of Germany

[73] Assignee: Linde Aktiengesellschaft, Fed. Rep. of Germany

[21] Appl. No.: 641,517

[22] Filed: Aug. 16, 1984

[30] Foreign Application Priority Data

Aug. 20, 1983 [DE] Fed. Rep. of Germany ..... 3330161

[51] Int. Cl.[4] ..... C22B 15/14

[52] U.S. Cl. ..... 75/93 R; 75/76; 75/93 AD

[58] Field of Search ..... 75/76, 72, 73, 45, 48, 75/93 R, 40, 59.3, 57, 93 AD

[56] References Cited

U.S. PATENT DOCUMENTS

| | | | |
|---|---|---|---|
| 1,238,409 | 8/1917 | Klinkenberg | 75/57 |
| 1,587,600 | 6/1926 | Nielsen | 75/76 |
| 1,958,754 | 5/1934 | Holley | 75/76 |
| 1,965,190 | 7/1934 | Hulme et al. | 75/76 |
| 3,199,977 | 8/1965 | Phillips et al. | 75/76 |
| 3,702,243 | 11/1972 | Miltenberger | 75/48 |
| 3,844,772 | 10/1974 | Sherman | 75/76 |
| 4,194,901 | 3/1980 | Gambacorta | 75/48 |

FOREIGN PATENT DOCUMENTS

| | | | |
|---|---|---|---|
| 10014 | 6/1963 | Japan | 75/76 |
| 5244 | 3/1966 | Japan | 75/76 |
| 1217274 | 12/1970 | United Kingdom | 75/72 |

*Primary Examiner*—Melvyn J. Andrews
*Attorney, Agent, or Firm*—James C. Wray

[57] ABSTRACT

The invention regards a procedure and a device to deoxidize metal melts by using a reducing agent which is introduced into the metal melt. In order to be able to produce metal melts with the lowest possible oxygen contents in the simplest and most economical manner, it has been determined to use alcohol, molasses or lignin, or a mixture of these materials, as reducing agents.

11 Claims, 1 Drawing Figure

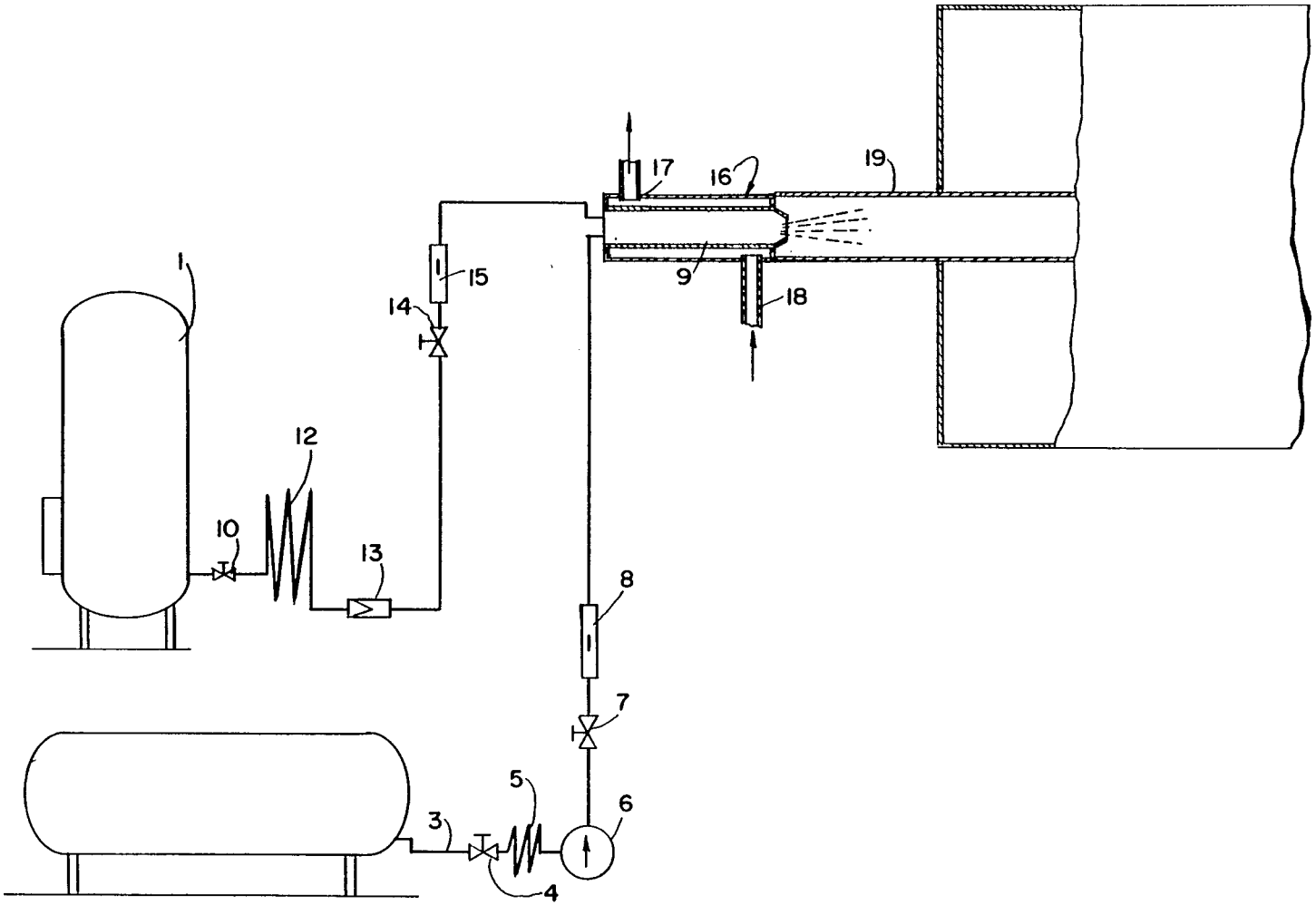
1
2
3
4
5
6
7
8
9
10
11
12
13
14
15
16
17
18
19

PROCEDURE FOR DEOXIDIZING METAL MELTS

The invention relates to a procedure for the deoxidization of metal melts by introducing a reducing agent into the metal melt, as well as a special application for this procedure.

Modern materials technology has created a growing interest for high-purity metals and alloys, in which emphasis is placed on extremely small oxygen contents. It is well known that hydrogen is introduced into metal melts in order to achieve high grades of purity in metals. The hydrogen reacts with the oxygen dissolved in the melt, as well as with the sulfur, creating gaseous reaction products which can be completely removed form the metal.

The difficulty with this well-known process, however, consists in that such a purification of liquid metal melts with hydrogen is relatively expensive due to the high costs associated with the production of hydrogen in the required quantities.

The invention is based on the necessity of developing a process as described above, in such a way, that metal melts with a high degree of purity, especially with the lowest possible oxygen contents, can be produced in a simple and economical way.

The above problem is solved according to the invention by using alcohol, molasses, or lignin, or a mixture of these materials.

According to the invention, alcohol can serve as a reducing agent. Due to the high temperature present in the metal melt, the alcohol is decomposed, mostly, into carbon monoxide and hydrogen, as well as, occasionally, into carbon and methane. In this case, cracking is associated with a volume expansion of the reducing agent at its introduction into the melt, thus causing a thorough bath movement in the melt. A rapid and complete mixing of the metal melt with the individual gas components takes place due to the vigorous bath movement. The introduced reducing agent is completely utilized, and, therefore, the total amount of reducing agent can be kept minimal. Appropriate alcohols are e.g. methanol, ethanol or isopropanol.

Besides this, other organic compounds can serve as reducing agents, such as ethyl acetate or fomic acid, which decompose at higher temperatures into carbon monoxide and hydrogen.

However, methanol is used as a reducing agent in accordance with an especially advantageous implementation of the invention. The methane and carbon components released by the cracking of other alcohols are not produced with methanol. Based on the lack of methane and carbon components, a possible undesired carburization of the metal melt can be considerably reduced. Additionally, methanol is decomposed in the metal melt at a ratio of 1:2 into carbon monoxide and hydrogen, so that 67% of the introduced methanol is present as hydrogen and 33% as carbon monoxide. These two components can react with the oxygen present in the metal melt. Since during the cracking of methanol from one liter of liquid methanol 1.67 $m^3$/(standard conditions) gas is created, which is composed of one third Co and two thirds $H_2$, and due to the fact that methanol, compared to other alcohols and to hydrogen (the reducing agent currently employed) is relatively inexpensive, methanol is indeed an extremely economical reducing agent. In this case, the volume expansion of methanol during cracking is great when 1 mol methanol vapor is cracked into 1 mol CO and 2 mols $H_2$, so that a considerable bath movement is attained while the quantity of the reducing agent is kept relatively small.

In accordance with the invention, the alcohol can be vaporized before its introduction into the metal melt. In order to reduce possible carburization to a minimum, it is adequate to add water and/or water vapor before vaporization. This procedure is especially important in the case of steel melts in which carburization is not desired. In the case of cast iron melts, which have a large carbon content to begin with, carburization hardly is a consideration, so that the addition of water is not indispensable. The addition of water, with which a reduction of the carbon contents can be attained, should not be greater than 2% to 3% of the total volume of the reducing agent since the associated oxygen introduction must be considered.

Further, it is also advantageous to mix the alcohol with nitrogen before and/or after vaporization. The nitrogen acts as a safety gas, as well as a carrier gas with which the introduction devices can be flushed before and/or after the introduction of the alcohol into the metal melt. Furthermore, under certain conditions, the mixture with nitrogen can influence the created gas combination in such a favorbale way that carburization problems can be reduced. If, for example, nitrogen is added to methanol, then any composition ratio of the gas can be adjusted, from a few percent C, to up to 33.3% CO; the ration CO : $H_2$ always being of 1:2. The metal melt receives proportionatelyless carbon by reducing the C contents due to an increase in the $N_2$ proportion within the total volume of the alcohol/nitrogen mixture.

Since the CO component also acts as a reducing agent for oxygen, it is necessary to adjust the nitrogen ratio of the mixture to 20% to 40% while mixing alcohol with nitrogen. In this case, the proportion of the nitrogen content is dependent on the type of metal melts being treated. For example, in the case of steel melts, in order to reduce the CO content, the proportion of nitrogen should be higher than with cast iron melts.

Another favorable application of the invention's concept consists in introducing the alcohol into a cracking device before it is introduced into the metal melt. In the cracking device it will be decomposed into hydrogen and carbon monoxide, and, possibley, other residual components. In the event that alcohols other than methanol are used as reducing agents, under certain conditions, it is desirable, depending on the type of metal melt, to separate the residual components of cracking, such as carbon and methane, before the introduction of the cracked gases into the metal melt, thus avoiding some carburization. Cracking the alcohol before its introduction into the metal melt is especially recommended when a greatly increased bath movement is anticipated in case of a direct introduction.

If during the above, cracking is carried out in an advantageous manner as high-temperature cracing, then the high gas temperature present after the cracking process can be used for the vaporization of the alcohol by performing a countercurrent heat exchange between the hot cracking gas and the alcohol being added to the cracking process. Additionally, in contrast to low-temperature cracking, no catalyzing agent and no drier are needed with high-temperature cracking, so that there is no danger that uncracked, humid alcohol reaches the metal melt in the event of catalyzer or drier failure.

High-temperature cracking is by all means economical, compared to low-temperature cracking, since during the latter, additional energy has to be applied for the vaporization of the alcohol, whereas in the case of high-temperature cracking, this energy can be saved by using the counter flow method of combining the hot cracking gases with the cold alcohol. Furthermore, in the event of low-temperature cracking in case of fouling of the catalyst, for safety reasons, two cracking installations must be used.

The introduction of alcohol into the metal melt can be accomplished with heat-resistant lances which are dipped into the metal melt. These lances are manufactured e.g. from a graphite/fireclay composite. The alcohol can also be introduced through several porous stones or nozzles arranged at the bottom of the container holding the metal melt. The efficiency of the introduction evice, which can be between 45% and 75%, influences the required alcohol quantity to a great extent. The introduction devices are connected with a tank and with an evaporator for the alcohol via heat-insulated pipes. A feed pipe for nitrogen can be connected before or after the evaporator. This feed pipe will be connected with a tank for liquid nitrogen. If the nitrogen pipe is connected in front of the alcohol evaporator, then the nitrogen gas can be used in a simple manner as a carrier gas for the alcohol. A control device has been incorporated in front of the alcohol evaporator. This device will enable the adjustment of the quantity of alcohol and nitrogen to be introduced.

In the event of deoxidization of copper with methanol, it has to be considered that when the vaporized methanol at 90° C. is introduced into the copper melt with a temperature of approximately 1200° C. it experiences an increase in temperature of 1100° C., and that for every 10° C. there is an expansion by 3%. It also has to be considered that the introduction system has an efficienty of 75%. Then 3 to 6 $m^3$ methanol have to be added for a treatment time span of 45 mins per ton of copper melt. With the above, a copper melt of 4000 ppm $O_2$ can be reduced to 1000 ppm $O_2$.

According to the invention, in addition to alcohols, molasses or lignin can also be used as a reducing agent. Molasses is the last discharge of sugar production still containg a large proportion of sugar, out of which, under consideration of economically viable possibilities, no more sugar can be yielded by continuing crystallization. Molassses originating from sugar cane, as well as molasses extracted from sugar beets, can be used as reducing agents.

Lignin is a mixture of aromatic compounds and is, besides cellulose, the main component of pine wood. Technically lignin can be extracted from the sulfite liquor, which is yielded in big amounts, if cellulose is digested by means of the sulfite process. Further lignin is yielded as a by-product in the course of the saccharification of wood.

Both of the last mentioned reducing agents decompose when introduced into the metal melt. During decomposition, carbon, hydrogen and hydrocarbons are produced. These decomposition products, as is known, have a reducing effect. Lignin and molasses commonly have water contents of approximately 20%. Part of the water introduced into the melt contributes to the formation of carbon monoxide and hydrogen. The remaining part of the water which is not coverted creates a bath movement in the metal melt. The bath movement is more active with an increased quantity of water. The carrier medium, which can be used for the tranport of molasses or lignin into the melt, will cause a more vigorous bath movement.

In a special implementation of the invention, a gas is used as a carrier, which is inert within the melt. Such gases are, for example: noble gases, but, preferably nitrogen.

In addition to inert gases, materials can also be used as carriers, which decompose into reduction components within the metal melt. In a special implementation of the invention, therefore, alcohols, especially methanol, are used as carriers.

In accordance with the invention, a metal melt which is to be deoxidized can also receive any mixture of molasses, lignin and any alcohol, possibly with the aid of an inert carrier. Further, it is possible to introduce two of these reducing agents, as well as all three reducing agents, in separate ways into a metal melt.

As previusly mentioned, molasses and lignin normally have a water content of 20%. In a special implementation of the invention, it has been proven to be especially favorable to increase the water content by addition of the same. Depending on the temperature of the molasses to be transported, the quantity to be moved increases by augmenting the water content.

According to a special implementation of the invention, therefore, the water content is increased to up to 90% (in regard to the dry substance). Since, however, the transported amount can only be increased slightly above a certain water content, it has been proven to be especially favorable to adjust the water content to a value between 25% and 50%.

In another version of the procedure described in the invention, molasses or lignin is heated before transport. The heating of these reducing agents can also increase the transported quantity.

For example, the transported quantity of molasses with a water content of 30% at a temperature of 70° C. is approximately four times greater than at a temperature of only 10° C. Obviously, it is is also possible to increase the temperature, as well as the water content of the molasses, or of the lignin, before transport.

In order to reduce the oxygen content of a copper melt of 30 tons from 4000 ppm $O_2$ to 1000 ppm $O_2$, molasses (depending on the efficiency of the system) are to be introduced in a quantity between 100 and 500 kg (dry substance) for a treatment time span of 15 to 60 minutes. If the vehicle used is nitrogen, then, hourly, per liter molasses, an amount of nitrogen of between 0.25 $m^3$ and 1 $m^3$ must be used.

An advantage of the procedure according to the invention consists in that the reducing agent can be added in a regulated manner.

Just as when adding alcohol as reducing agents, lances or nozzles can be used for the introduction of molasses or lignin into the metal melt. According to a special implementation of a device suitable for the procedure according to the inventio, an injection device enters an introduction system. The introduction system has an input for the carrier medium and an input for the reducing agent, and both of these inputs enter a mixing area.

The introduction system prevents a direct contact between the metal melt and the mixing device, thus preventing the destruction of the latter. The carrier medium and the reducing agent are mixed in the mixing device installed in front of the injection device.

In a preferential version of a device according to the invention, the feed pipe for the reducing agent is heated. The heating can be accomplished with electricity or with an indirect heat exchange with a heating element.

According to another implementation of the invention, a spraying device has proven to be effective. In this device, the feed lines entering the mixing area are placed coaxially to one another, and the central feed pipe enters the mixing area via a nozzle. Thus, the reducing agent can be fed via the central feed pipe, can be sprayed with the nozzle, and can be atomized with the carrier medium flowing around the central feed pipe within the circular space.

According to another implementation of the invention, the introduction system consists of heat-resistant material. The introduction system can consist, with equal efficiency, of a fusible rod lance.

Especially advantageous is the use of a procedure according to the invention, and of a device, also according to the invention, for the deoxidization of copper melts. This is based on the fact that there are no carburization problems due to the CO components, or due to the carbon or methane components of the cracked reducing agent.

In the following, a schematic diagram will explain an implementation example of a device according to the invention:

BRIEF DESCRIPTION OF THE DRAWING

The FIGURE is a schematic representation of the preferred embodiment.

In the implementation example, nitrogen will be used as the carrier medium and molasses as the reducing agent. Nitrogen is stored in its liquid form in container 1. Molasses, with a water content of between 20% and 50% is stored in container 2. The molasses is suctioned by pump 6 via pipe 3 with valve 4, and is introduced under pressure into atomizing device 9 by way of valve 7 and flow meter 8. An electric heating device 5 can be installed between valve 4 and pump 6. The molasses to be transported can be heated in this device. Liquid nitrogen is taken from conatiner 1 via pipe 11 and valve 10 and is subsequently vaporized in vaporizer 12. The evaporated nitrogen flows through check valve 13, another valve 14, and a flow meter 15. Subsequently, gaseous nitrogen enters an atomizing device and serves for the atomization of the molasses fed in, as well as for the transport of the same into the metal melt. The atomizing device can also be heated, such, as for example, indirectly with water, which flows thorugh a circular housing 16 with inlet 18 and outlet 17. The mixture molasses/nitrogen exits the atomizing device and enters a tube-shaped introduction system 19, which in turn is dipped into the metal melt, i.e. obliquely to the melt surface. An atomizing nozzle can be used to atomize the reducing agent. This nozzle mainly consists of two pipes placed coaxially to one another. The reducing agent flows through the central, inner pipe an exits the nozzle as a central jet. The carrier medium flows into the area between inner and outer pipe and also exits the nozzle. When the carrier medium exits the the nozzle, it will flow in the direction of the central jet, thus serving for the atomization of the reducing agent.

I claim:

1. Procedure for deoxidizing metal melts, comprising, adding to the melt a water containing liquid reducing agent selected from the group consisting of molasses and lignin, wherein the reducing agent decomposes and produces carbon, hydrogen, and hydrocarbons which have reducing effects, and wherein a part of the water occurring in the reducing agent forms CO and hydrogen, and another unconverted part creates a bath movement in the metal melt.

2. The procedure of claim 1 further comprising, combining the liquid reducing agent with a carrier to facilitate introduction of the reducing agent into the melt, wherein the carrier contributes to bath movement.

3. The procedure of claim 2 wherein the carrier comprises an inert gas.

4. The procedure of claim 3 wherein the inert gas is nitrogen.

5. The procedure of claim 2 wherein the carrier comprises an alcohol.

6. The procedure of claim 5 wherein the alcohol is methanol.

7. The procedure of claim 1 further comprising adding water to the reducing agent before introduction into the melt to increase bath movement.

8. The procedure of claim 7 wherein the water content in proportion to the dry substance is 25–50 percent.

9. The procedure of claim 1 further comprising, heating the reducing agent prior to adding the reducing agent to the melt.

10. The procedure of claim 2 wherein the reducing agent is added to the melt by first ixing the reducing agent and carrier medium in mixing means disposed outside of the melt, and then adding the mixture to the melt through introduction means extending into the melt.

11. The procedure of claim 10 wherein the mixing means comprises an atomizer which atomizes the reducing agent.

* * * * *

UNITED STATES PATENT OFFICE

CERTIFICATE OF CORRECTION

Patent No. 4,685,965 Dated August 11, 1987

Inventor(s) Reinhard Strigl

It is certified that error appears in the above-identified patent and that said Letters Patent are hereby corrected as shown below:

Column 6, line 44, change "ixing" to --mixing--.

Signed and Sealed this

Eighth Day of December, 1987

*Attest:*

DONALD J. QUIGG

*Attesting Officer*

*Commissioner of Patents and Trademarks*